US006951377B2

(12) United States Patent
Knoerzer et al.

(10) Patent No.: US 6,951,377 B2
(45) Date of Patent: Oct. 4, 2005

(54) INSIDE PRINTING OF FLEXIBLE PACKAGES

(75) Inventors: Anthony Robert Knoerzer, Plano, TX (US); Garrett William Kohl, Allen, TX (US)

(73) Assignee: Frito-Lay North America, Inc., Plano, TX (US)

( * ) Notice: Subject to any disclaimer, the term of this patent is extended or adjusted under 35 U.S.C. 154(b) by 221 days.

(21) Appl. No.: 10/202,981

(22) Filed: Jul. 24, 2002

(65) Prior Publication Data

US 2004/0017075 A1 Jan. 29, 2004

(51) Int. Cl.[7] ..... B41J 29/38

(52) U.S. Cl. ..... 347/14; 347/101; 347/105; 427/8; 427/533

(58) Field of Search ..... 347/2, 14, 19, 347/21, 101, 105; 427/8, 256, 466, 533, 535

(56) References Cited

U.S. PATENT DOCUMENTS 4,009,551 A * 3/1977 Greenawalt et al. ..... 53/451
5,780,118 A * 7/1998 Tracy et al. ..... 427/508
6,599,582 B2 * 7/2003 Kiguchi et al. ..... 427/466

* cited by examiner

*Primary Examiner*—Lamson Nguyen
*Assistant Examiner*—Blaise Mouttet
(74) *Attorney, Agent, or Firm*—Colin P. Cahoon; Chad E. Walter; Carstens & Cahoon, LLP

(57) ABSTRACT

A flexible package, and method for manufacturing same, that provides for the presentation of graphics inside the package using existing converter and vertical form and fill packaging machine technology. The invention involves pre-treating an area with ionized gases prior to the addition of the graphic to allow the graphic to adhere to the surface.

16 Claims, 4 Drawing Sheets

INSIDE PRINTING OF FLEXIBLE PACKAGES

BACKGROUND OF THE INVENTION

1. Technical Field

The present invention relates to inside printing of flexible packages constructed from either a vertical or horizontal form and fill packaging machine, and the method for making same, that provides for a graphics presentation inside the package for promotional or other purposes. The invention allows for use of existing film converter and packaging technology to produce a package that meets present required packaging guidelines with minimal increased costs.

2. Description of Related Art

Vertical form, fill, and seal packaging machines are commonly used in the snack food industry for forming, filling, and sealing bags of chips and other like products. Such packaging machines take a packaging film from a sheet roll and forms the film into a vertical tube around a product delivery cylinder. The vertical tube is vertically sealed along its length to form a back seal. The machine applies a pair of heat-sealing jaws or facings against the tube to form a transverse seal. This transverse seal acts as the top seal on the bag below and the bottom seal on the package being filled and formed above. The product to be packaged, such as potato chips, is dropped through the product delivery cylinder and formed tube and is held within the tube above the bottom transverse seal. After the package has been filled, the film tube is pushed downward to draw out another package length. A transverse seal is formed above the product, thus sealing it within the film tube and forming a package of product. The package below said transverse seal is separated from the rest of the film tube by cutting across the sealed area.

The packaging film used in such process is typically a composite polymer material produced by a film converter. For example, one prior art composite film used for packaging potato chips and like products is illustrated in FIG. 1*a*, which is a schematic of a cross-section of the film illustrating each individual substantive layer. FIG. 1*a* shows an inside, or product side, layer 16 which typically comprises metalized oriented polypropylene ("OPP") or metalized polyethylene terephthalate ("PET"). This is followed by a laminate layer 14, typically a polyethylene extrusion, and an ink or graphics layer 12. The ink layer 12 is typically used for the presentation of graphics that can be viewed through a transparent outside layer 10, which layer 10 is typically OPP or PET.

Subsequent to being produced by the converter, the composite polymer film is sent to a slitter where it is cut into three strips. Each strip can then be wound into a sheet roll prior to being sent to a vertical form and fill machine, or bagmaker.

The prior art film composition shown in FIG. 1*a* is ideally suited for use on vertical form and fill machines for the packaging of food products. The metalized inside layer 16, which is usually metalized with a thin layer of aluminum, provides excellent barrier properties. The use of OPP or PET for the outside layer 10 and the inside layer 16 further makes it possible to heat seal any surface of the film to any other surface in forming either the transverse seals or back seal of a package.

Typical back seals formed using the film composition shown in FIG. 1*a* are illustrated in FIGS. 2*a* and 2*b*. FIG. 2*a* is a schematic of a "lap seal" embodiment of a back seal being formed on a tube of film. FIG. 2*b* illustrates a "fin seal" embodiment of a back seal being formed on a tube of film.

With reference to FIG. 2*a*, a portion of the inside metalized layer 26 is mated with a portion of the outside layer 20 in the area indicated by the arrows to form a lap seal. The seal in this area is accomplished by applying heat and pressure to the film in such area. In the embodiment shown in FIG. 2*b*, the inside layer 36 is folded over and then sealed on itself in the area indicated by the arrows. Again, this seal is accomplished by the application of heat and pressure to the film in the area illustrated.

As noted, a benefit of both the prior art fin seal and lap seal design is the containment of the product in the package by a barrier layer (the metalized inside layer) and an effective seal that keeps out light, oxygen, and moisture. It may be desirable to provide a graphics capability inside a sealed package. This would allow for promotional information or coupons to be maintained inside the package and only accessible after the consumer has opened the package. For example, a promotional prize campaign could be offered with the prize announcements being maintained inside the package. Likewise, coupons offering product rebate rewards, promotional prize points, or discounts on products could be maintained within the sealed package. Food grade inks, however, do not adhere well to the barrier layer.

One prior art method used to provide a graphics capability inside the package involves the use of a paper insert dropped with the product into the package during filling. When the consumer opens the package, the paper insert can be removed for viewing and use. This method has several drawbacks, however. The reliability of placing a single paper insert in each bag (by dropping the paper with a weighed amount of product) is a major consideration, particularly in small packages. A capacity issue is raised by the need to rent inserters to be used during the filling process. Foreign matter detectors are also frequently set off by the detection of the paper insert within the bag. The insertion of a piece of paper can raise the solvent level in the package beyond acceptable levels. All of the above greatly adds to the expense of each single package.

Another approach to this issue is illustrated in FIG. 1*b*, which is again a schematic cross-section of a packaging film. As with the embodiment shown in FIG. 1*a*, the embodiment shown in FIG. 1*b* comprises an outside OPP layer 10 followed by an ink layer 12, a laminate layer 14, and a metalized OPP or PET layer 16. However, an additional laminate layer 14' is applied to the metalized layer 16 so that an additional ink layer 12' and OPP or PET layer 10' can be used as the new inside layer 10'. The use of the ink layers 12, 12' as the second to last layer on both the outside and inside of the package allows for a full graphics capability on both the outside and the inside of the film. The additional film, however, adds approximately sixty percent (60%) to the cost of the material when compared with the embodiment shown in FIG. 1*a*. Overall capacity is also cut in half, since the film must be run through a typical converter twice. Further, since the material is 60% thicker, it cannot be run on a vertical form and fill machine at speeds as high as that used to make packages out of the embodiment shown in FIG. 1*a*. This is because longer dwell times must be used to form all the seals involved.

Another prior art approach to providing graphics within the bag would involve the application of the graphics directly to the inside metalized layer 16 shown in FIG. 1*a*.

The application of such graphics can be accomplished using an inkjet printer. Food grade inks, however, do not adhere well to the inside metalized layer 16 because it is a low surface energy film. A low surface energy film is a film with a surface of less than 35 dynes/cm. Ink adhesion is poor on low surface energy films because the cohesive forces of the ink molecules have greater attraction to one another than to the inside metalized layer 16, causing the ink 47 to bead up as illustrated in FIG. 4*a*. The surface energy of the metalized inside layer 16 of FIG. 1*a* is approximately 30 dynes/cm whereas the wetting tension of the food grade inks is approximately 36 dynes/cm. Increasing the surface energy of the metalized inside layer 16 above the wetting tension of the food grade inks prevents the ink 47 from beading up (FIG. 4*a*). This increase in surface energy can be accomplished by treating the surface 46 with a flame or corona discharge. In FIG. 3, for example, a corona discharge is created by applying a high voltage from an electrode 32 to a dielectric 34. This generates ozone and when applied to the surface of the OPP layer 36 the surface energy of the OPP layer is increased which increases the adhesion force between the ink and the OPP layer allowing the ink to wet the layer, as shown in FIG. 4*b*, resulting in more permanent ink 48 contact. The treating of the inside layer 40, however, increases the melting point from a 180° F.–320° F. range for the untreated layer 46 to a 280° F.–320° F. range for the treated layer 40, which can result in longer dwell times which translates into slower production at the bagmaker, and the inability to produce an acceptable seal. Thus, sealing efficiency is greatly reduced when the treated layer 40 is used as a sealing surface. An additional risk occurs when sealing apparatus temperatures surpass 270° F. because of the risk that the outside OPP layer 10 in FIG. 1*a* may melt.

Another approach to solving this problem is to use a metalized inside layer 16 with a material that has a higher surface energy. For example, polyester or PET, has a surface energy of 43 dynes/cm. However, metalized OPP and PE films are less expensive than higher surface energy films such as polyester.

Consequently, a need exists for a package construction method and resultant package that allows for graphics that are available on the inside of a package upon opening of the package by the consumer that can be adapted to existing converter and form and fill packaging machines without reducing the capacity of either and that allows use of the lesser expensive metalized OPP film without compromising the sealing efficiency.

SUMMARY OF THE INVENTION

The proposed invention involves a spot treatment of the product side of a flexible film used for the formation of a flexible film bag, thus allowing for ink printing on the area of the spot treatment. The spot treatment increases the surface energy of the barrier layer by treatment with ionized gases or heat, where the only area treated is that area where a graphic is desired to appear inside the formed package. By increasing the surface energy, the ink applied to the flexible film adheres to the treated portion. The invention then involves, in one embodiment, slitting the web, allowing the treated portion to cool and then administering the graphic to the treated portion.

The method uses existing converter and form and fill machine technology without affecting the capacity of either. Bag sealing is not affected, as the treated portion is small and located away from seal areas on the film. Further, the lesser expensive low surface energy films can be used. Consequently, the use of a treated portion adds little to the cost of each bag.

The above as well as additional features and advantages of the present invention will become apparent in the following written detailed description.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Figure 4A:
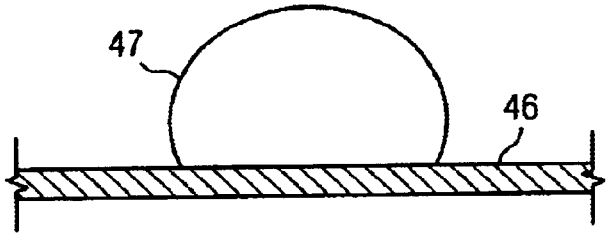
FIGS. 4*a*, 4*b*, and 4*c* are schematic representations of ink on an untreated, entirely treated and partially treated surfaces, respectively.
Figure 4B:
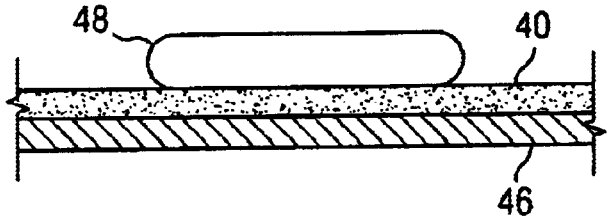
Figure 4C:
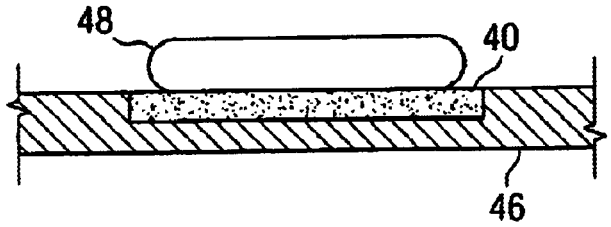
Figure 5A:
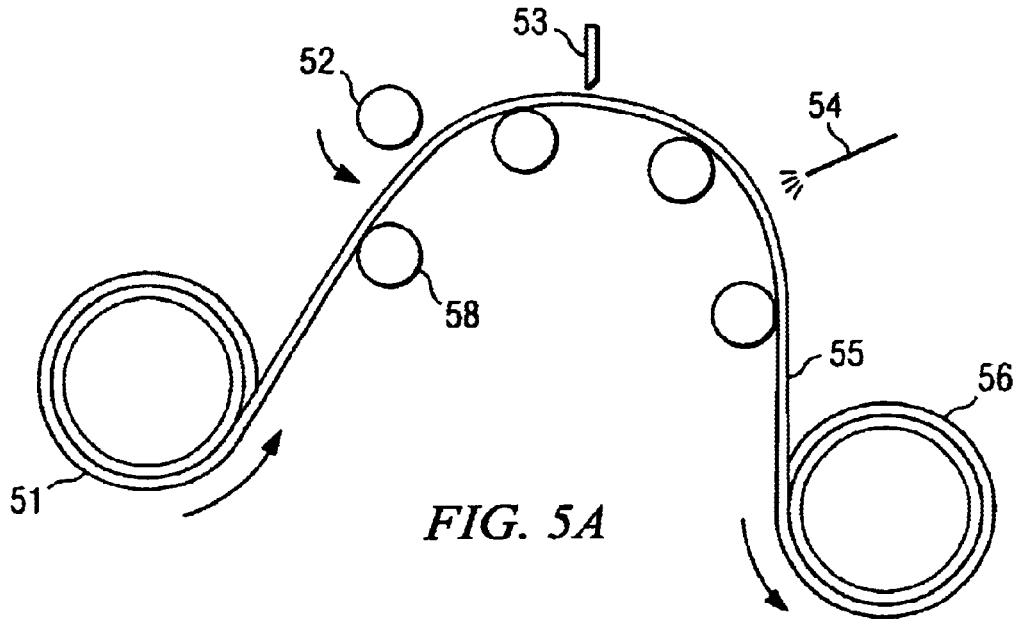
FIG. 5*a* is a schematic representation of one embodiment of the location of the treatment drum with respect to the slitter(s) and ink jet(s)

FIG. 4*c* shows a bead 48 of ink adhering to the treated film 40, but instead of treating the entire layer as indicated in FIG. 4*b*, only an area 40 just slightly larger than the graphic to be applied is treated. FIG. 5*a* illustrates one embodiment of the invention where the film is unwound from a roll 51 and treated with ionized gases produced by a flame or corona from a treatment drum 52, preparing the surface for ink adhesion.

After treatment, the surface is then cooled as it moves past the slitter 53. The surface of the treated portion 40, as indicated by FIG. 4*c*, must be allowed to cool less than 150° F., which typically takes less than 0.1 seconds. This can be done using an air blast or chill roll prior to application of the ink to minimize vaporization of the ink and insure optimum print quality. The ink should be applied within 60 days of surface treatment because the treated surface loses its elevated surface energy with time. An ink jet printer 54, a device that squirts a small quantity of ink from a reservoir through a tiny hole to create an image, then applies the desired graphic to the treated portion, or registered location. The registered location is the treated portion and its relative location is determined by using a pre-printed mark, or registration, on the film as a reference point in conjunction with a sensor that detects the registration.

After printing, the web 55 is rewound onto a sheet roll 56. This provides for the presentation of graphics within the package ultimately formed. In alternative embodiments, the film can come directly from the converter instead of from a wound roll 51 or can proceed after printing directly to the bagmaker instead of to a wound roll 56.

Figure 1A:
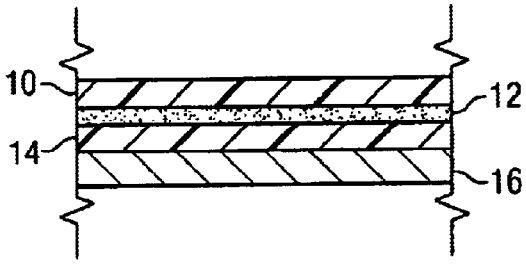
FIG. 1A (PRIOR ART)
FIGS. 1*a* and 1*b* are schematic cross-section views of prior art packaging films.
Figure 5B:
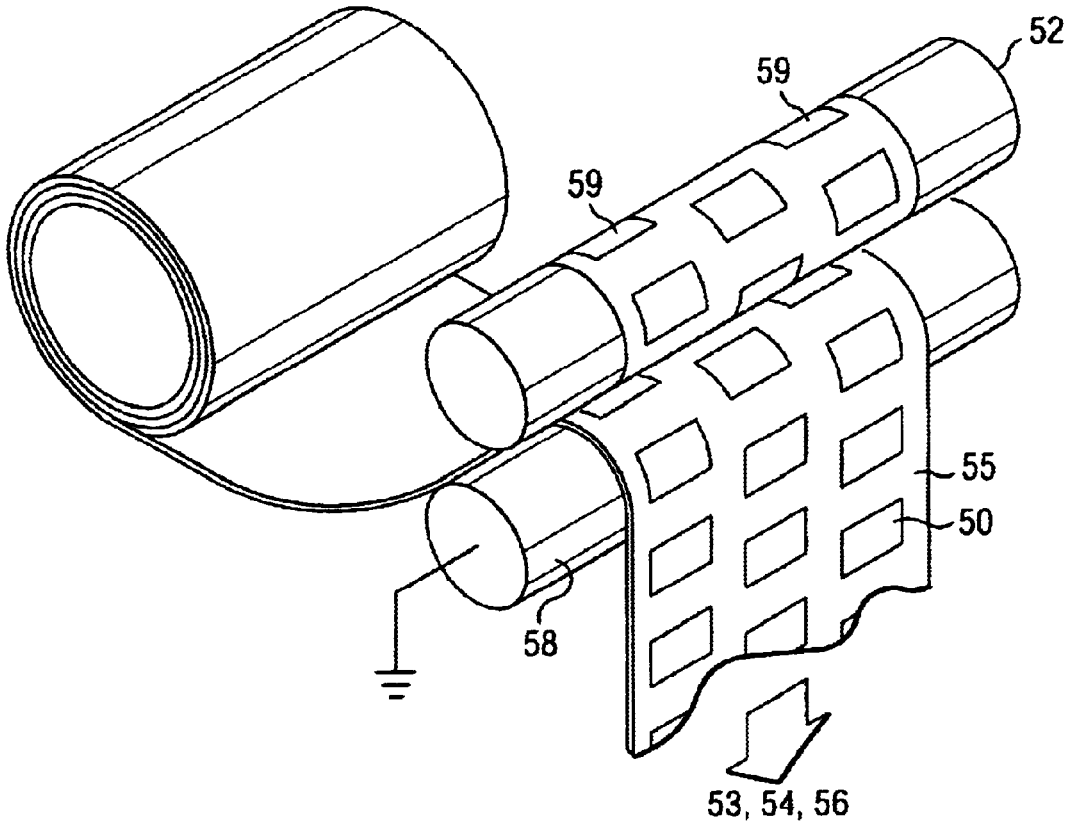
FIG. 5*b* is a schematic representation of one embodiment of the application of a flame or corona to specific locations on the barrier layer.

The treatment drum 52, as shown in FIG. 5*b*, uses an electric current that travels from a high voltage, high-frequency electrode in the treatment drum 52 through a window 59 towards the dielectric electrode 58, as the web 55 passes over, to create an ozone-generating spark, or corona. The ozone within this corona reacts with the metalized inside layer 16 indicated in FIG. 1*a* to raise the surface energy allowing for greater ink adhesion as illustrated by FIG. 4*c*. The treatment drum windows 59 are mounted in such an off-set manner as required to maintain balanced treatment drum 52 rotation. Alternatively, the corona treater can be made to cycle on and off using a simple timing switch, which is very similar to what is used to control the electronic timing (spark plugs) in all late model cars.

Figure 1B:
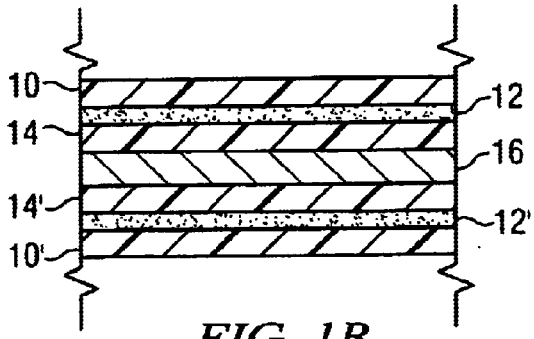
FIG. 1B (PRIOR ART)
Figure 2A:
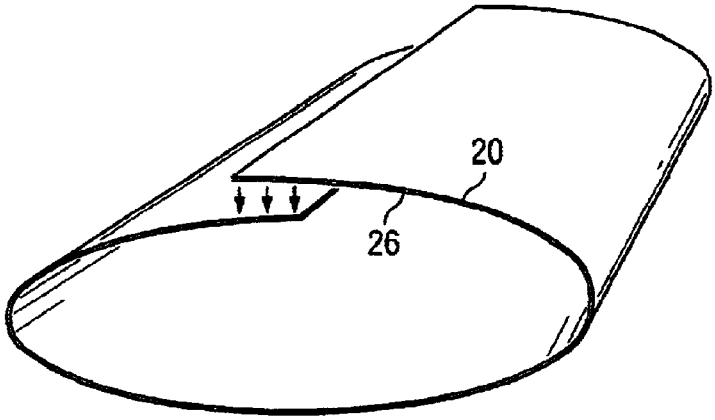
FIG. 2A (PRIOR ART)
FIG. 2*a* is a schematic cross-section view of a tube of packaging film illustrating the formation of a prior art lap seal.
Figure 2B:
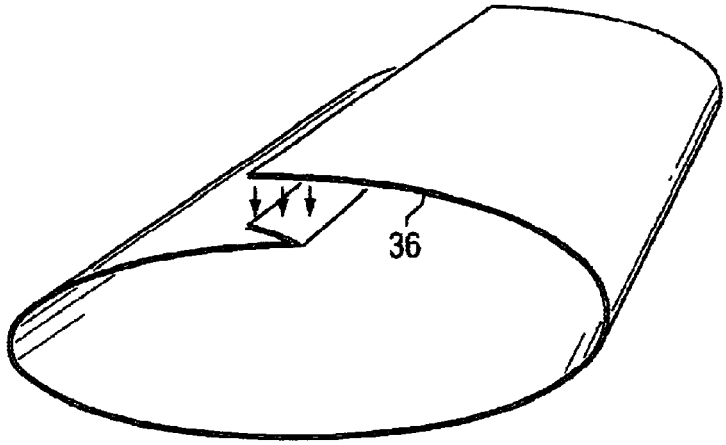
FIG. 2B (PRIOR ART)
FIG. 2*b* is a schematic cross-section of a tube of packaging film illustrating the formation of a prior art fin seal.
Figure 6A:
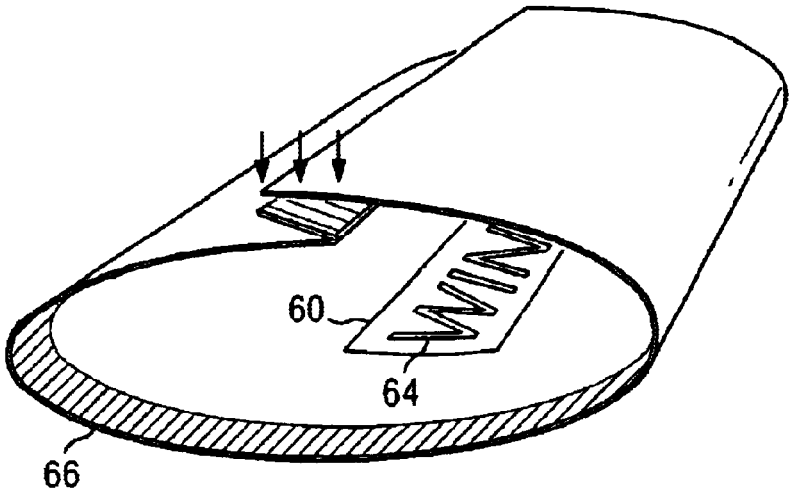
FIG. 6*a* is a schematic cross-section of an alternative embodiment of a graphic placed on the metalized inside layer by the present invention methods.
Figure 6B:
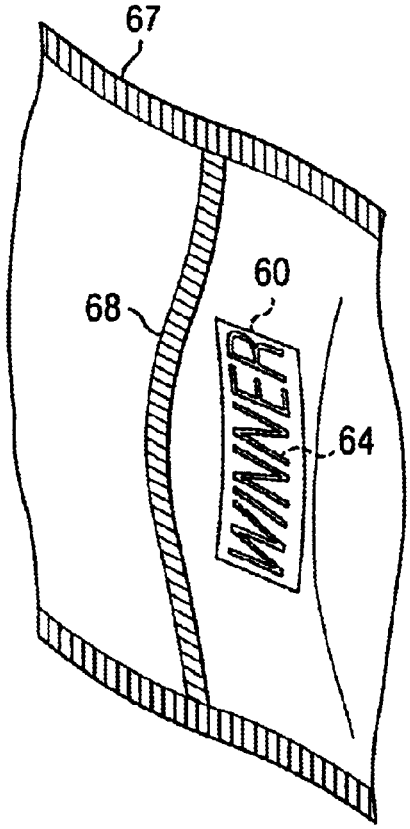
FIG. 6*b* is a perspective view of displaying one embodiment of the location of the graphic with respect to the seal areas.

FIG. 6*a* shows the seal area 66 with respect to one treated location 60 containing a printed message 64 within a bag. The seal area 66 is the border area on the product side layer that extends approximately 0.5 inches from the edge of the bag. FIG. 6*b* shows one embodiment of the message location 64 (shown in phantom as it is inside the bag and is not visible from the exterior) after a bag has been formed and sealed in the bagmaker. Advantages of using this embodiment over any prior art solution include the ability for the areas required for sealing, or seal areas 66, 67, 68, as indicated in FIGS. 6*a* and 6*b*, remaining safely away from the treated portion 60. This means that seal efficiency is not sacrificed when making transverse seals 67 and back seals 68. The graphic placement 64 directly on the inside of the package is superior to prior art formed by additional films as illustrated in FIG. 1*b* because less processing and material is required as well as less dwell time during bag formation.

Figure 3:
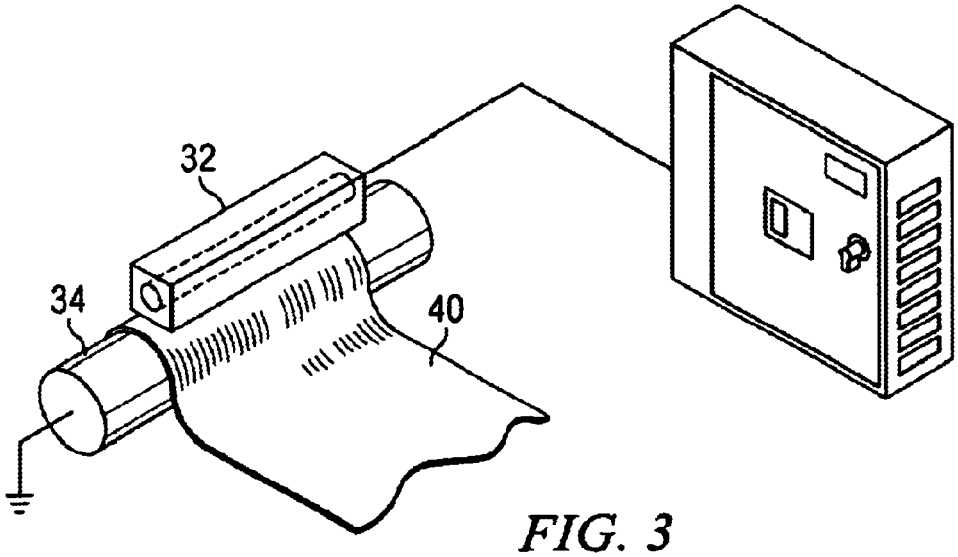
FIG. 3 (PRIOR ART)
FIG. 3 is a perspective view of a prior art corona discharge treatment of an entire side of film.

The amount of ionized gases produced by the corona treater can be regulated by controlling the power to the corona treater. Excess gases are typically catalyzed (similar to an automotive-type catalytic converter) and vented away. Controlling the power to the corona treater consists of changing the power supply output to control the timing of the application of high voltage from the electrode 32 to the dielectric 34 as indicated by FIG. 3 to correspond with a registered location.

In the case of a flame treater, the plasma, consisting of molecular oxygen and other oxygenated radicals, produced by flame treatment can be regulated by controlling the fuel/air ratio, temperature, and the flame grate. For example, a control valve on the flame treatment fuel source can be configured to operate based on a registration. The valve to the fuel source can pulsate between a first position and a second position and back to the first position. It may also be desirable to control and use other gases, such as oxygen, in the same manner to aid the flame treatment process.

In another embodiment, the treated portion 50 of FIG. 5*b* can be created by a series of high-voltage high-frequency pen-like corona treaters (not shown) in place of the treatment drum 52. The pen like treaters can be activated for a relatively short period of time to treat registered locations.

In other embodiments, the location of the treating device can be modified. For example, individual roll treaters, rather than a single treatment drum, with treatment windows 59 can be used before or after the slitter 53. In addition, other embodiments can use some other ionized gas producing device such as a flame treater or a plasma treater in place of or in addition to a corona discharge treater. A plasma treater creates an ionized gas using electromagnetic fields.

Advantages of forming packages using the embodiments illustrated in FIG. 5*a* over any prior art solution include the ability to use existing converter and form and fill packaging machines with modification required only before and after the slitter with no loss in packaging capacity or throughput, and minimal increases in overall packaging costs. Capacity of the converter and the form and fill packaging machines are not affected at all, since the film used by the present invention is formed in one pass through the converter and, in physical structure, is the same as prior art films. No increase in dwell times is required in forming the seals involved because the seal areas 66, 67, 68, as shown in FIGS. 6*a* and 6*b*, are not treated and no other capacity issues are raised through the introduction of a foreign object. The increased cost is minimal, since the invention only requires installation of a treatment drum 52 and ink jet printers 54, as shown in FIGS. 5*a* and 5*b*.

While the invention has been particularly shown and described with reference to a preferred embodiment, it will be understood by those skilled in the art that various changes in form and detail may be made therein without departing from the spirit and scope of the invention.

What is claimed is:

1. A method for placing graphics in a specific location on a low surface energy film, said low surface energy film having a surface energy of less than 35 dynes/cm, said method comprising the steps of:

a) treating the surface of said film with an ionized gas at a registered location on the film;

b) allowing the treated portion to cool to less than 150° F.;

c) using at least one sensor to detect a visible registration mark on the film to ascertain the relative registered location of the treated portion; and d) using the sensor-detected information to apply an ink graphic within the treated portion.

2. The method of claim 1 wherein the ionized gas is produced from a spark caused by a corona treater contained in a drum wherein the drum has at least one window opening.

3. The method of claim 1 wherein the drum rotates and the rotational speed of said drum is controlled by a sensor detecting a registration mark visible on a treated film.

4. The method of claim 3 wherein the drum has at least two window openings and said window openings are placed on the drum in such a manner as to maintain balance during drum rotation.

5. The method of claim 1 wherein ionized gas includes gas produced by a flame contained in a drum wherein the drum has at least one window opening.

6. The method of claim 5 wherein the drum rotates and wherein further the rotational speed of said drum is controlled by a sensor detecting a registration mark visible on a treated film.

7. The method of claim 1 wherein the step of treating said film with an ionized gas includes ionized gas produced by a plasma source.

8. The method of claim 1 wherein the ink graphic is applied via an ink jet printer.

9. The method of claim 1 wherein the low surface energy film is comprised of metalized oriented polypropylene and polyethylene.

10. The method of claim 1 wherein the low surface energy film is comprised of polyethylene and polyethylene terephthalate.

11. A method for placing graphics in a specific location on a low surface energy film, said low surface energy film having a surface energy of less than 35 dynes/cm, said method comprising the steps of:

a) treating a portion of the surface of the low surface energy film with an ionized gas wherein at least one sensor is used to detect a visible registration mark on the film to ascertain the relative registered location of the portion to be treated;

b) allowing the treated portion to cool to less than 150° F.; and c) applying an ink graphic to only the treated portion as indicated by the at least one sensor.

12. The method of claim 11 wherein the ionized gas is produced from at least one corona pen adjacent to said film.

13. The method of claim 12 wherein the step of treating said film with an ionized gas includes controlling the power to the corona pen to regulate the production of ionized gases by using the at least one sensor detecting the registration mark visible on the treated film.

14. The method of claim 11 wherein the ionized gas is produced from at least one flame nozzle adjacent to said film.

15. The method of claim 14 wherein the step of treating said film with an ionized gas includes controlling the flow of at least one gas line to control the flame to regulate the production of ionized gases by using the at least one sensor detecting the registration mark visible on the treated film.

16. The method of claim 11 wherein the ionized gas is produced from at least one plasma producing device adjacent to said film.

* * * * *